US008540592B1

(12) United States Patent
Coppenrath

(10) Patent No.: US 8,540,592 B1
(45) Date of Patent: Sep. 24, 2013

(54) BALL TARGET ASSEMBLY

(76) Inventor: Joshua C. Coppenrath, Green Harbor, MA (US)

( * ) Notice: Subject to any disclaimer, the term of this patent is extended or adjusted under 35 U.S.C. 154(b) by 170 days.

(21) Appl. No.: 13/195,595

(22) Filed: Aug. 1, 2011

(51) Int. Cl.
*A63B 69/00* (2006.01)

(52) U.S. Cl.
USPC ..... 473/435; 473/431; 473/454

(58) Field of Classification Search
USPC ..... 473/422, 421, 434, 435, 454, 478, 473/471; D21/705; 273/395, 396, 407, 410
See application file for complete search history.

(56) References Cited

U.S. PATENT DOCUMENTS

| | | | | | |
|---|---|---|---|---|---|
| 2,944,816 | A | | 7/1960 | Dixon | |
| 3,706,451 | A | | 12/1972 | Dixon | |
| 3,711,092 | A | | 1/1973 | Hogue | |
| 4,148,555 | A | | 4/1979 | Lerman | |
| 4,210,326 | A | * | 7/1980 | Booth et al. | 473/454 |
| 4,497,485 | A | | 2/1985 | Macosko | |
| 4,650,189 | A | * | 3/1987 | Rajacich | 473/434 |
| 4,872,674 | A | | 10/1989 | Deal | |
| 4,932,657 | A | * | 6/1990 | Hailer et al. | 473/446 |
| 5,332,230 | A | * | 7/1994 | Benedict | 473/594 |
| 5,333,856 | A | * | 8/1994 | Gery | 473/454 |
| D359,538 | S | | 6/1995 | Hague | |
| 5,549,304 | A | * | 8/1996 | Davis | 273/396 |
| 5,573,239 | A | * | 11/1996 | Ryker et al. | 473/436 |
| 5,573,240 | A | | 11/1996 | Humboldt | |
| 5,672,125 | A | * | 9/1997 | Ross | 473/421 |
| 5,938,546 | A | * | 8/1999 | Caruso | 473/434 |
| 6,155,936 | A | * | 12/2000 | Dorr | 473/456 |
| 7,448,968 | B1 | * | 11/2008 | Petion | 473/446 |
| 7,704,169 | B1 | * | 4/2010 | Bove et al. | 473/426 |
| 2012/0129633 | A1 | * | 5/2012 | Chen | 473/435 |

* cited by examiner

*Primary Examiner* — Mitra Aryanpour

(57) ABSTRACT

A ball target assembly includes a support that includes a front wall having a front side, a back side and a perimeter edge extending between the front and back sides. The front wall has an opening therein extending into the front side and outwardly of the back side. A rear wall is hingedly coupled to the front wall along an upper edge of the front wall and an upper edge of the rear wall. A ball catch is mounted to the back side and covers the opening. The ball catch is formed of a loose material configured to catch and retain a ball thrown through the opening.

10 Claims, 6 Drawing Sheets

BALL TARGET ASSEMBLY

BACKGROUND OF THE DISCLOSURE

Field of the Disclosure

The disclosure relates to ball target devices and more particularly pertains to a new ball target device for providing an area to aim at while throwing a ball and which will catch and retain the ball.

SUMMARY OF THE DISCLOSURE

An embodiment of the disclosure meets the needs presented above by generally comprising a support that includes a front wall having a front side, a back side and a perimeter edge extending between the front and back sides. The front wall has an opening therein extending into the front side and outwardly of the back side. A rear wall is hingedly coupled to the front wall along an upper edge of the front wall and an upper edge of the rear wall. A ball catch is mounted to the back side and covers the opening. The ball catch is formed of a loose material configured to catch and retain a ball thrown through the opening.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
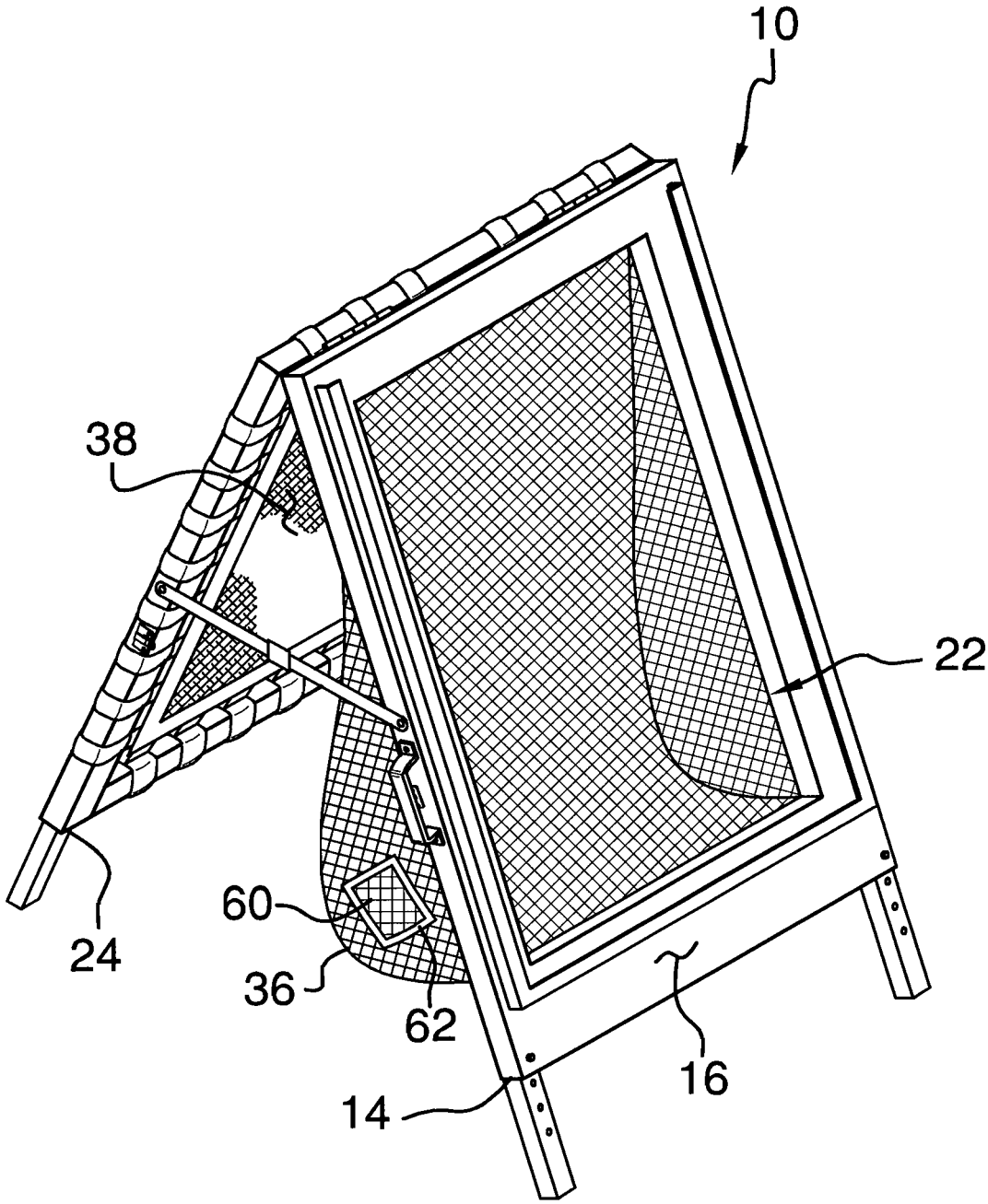
FIG. 1 is a front perspective view of a ball target assembly according to an embodiment of the disclosure.
Figure 2:
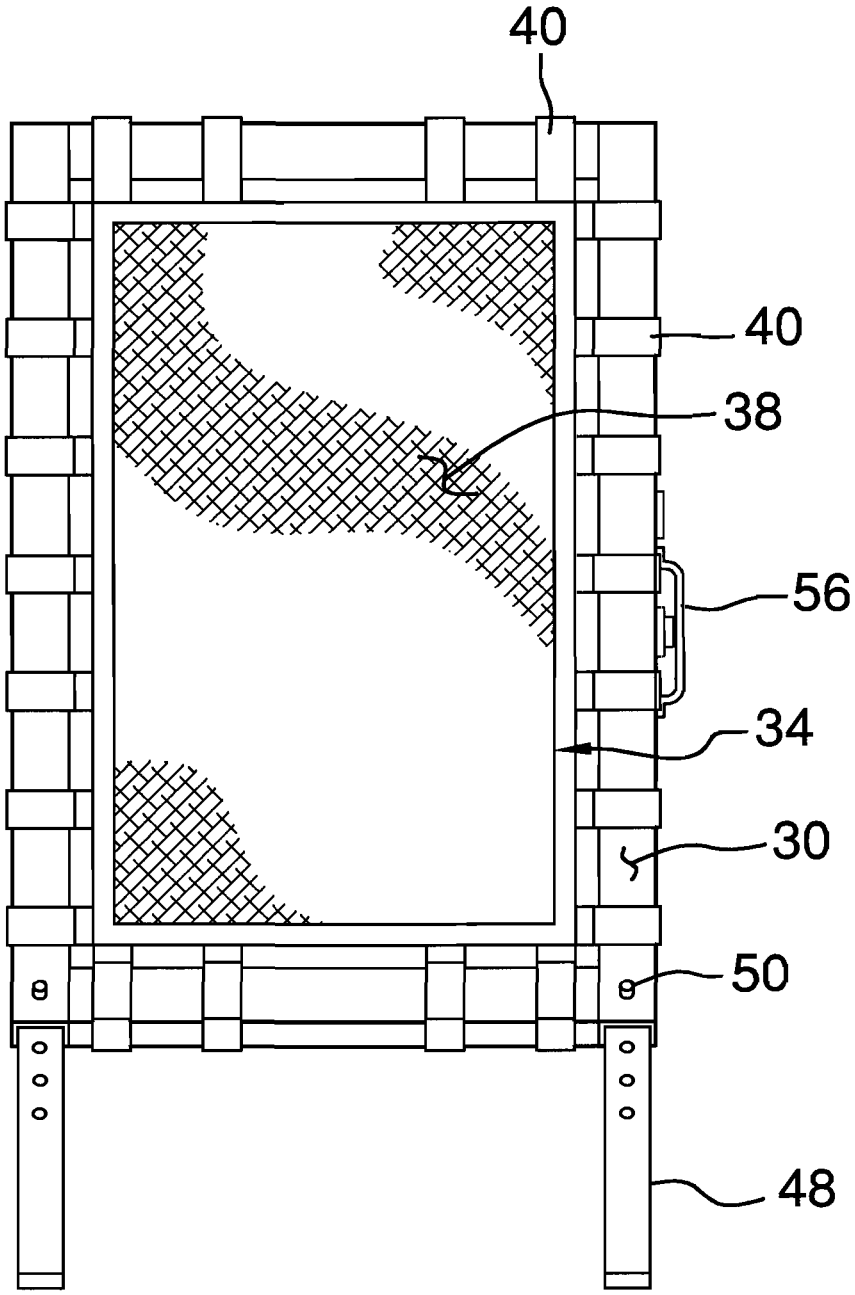
FIG. 2 is a rear view of an embodiment of the disclosure.

With reference now to the drawings, and in particular to FIGS. 1 through 6 thereof, a new ball target device embodying the principles and concepts of an embodiment of the disclosure and generally designated by the reference numeral 10 will be described.

As best illustrated in FIGS. 1 through 6, the ball target assembly 10 generally comprises a support 12 that includes a front wall 14 having a front side 16, a back side 18 and a perimeter edge 20 extending between the front 16 and back 18 sides. The front wall 14 has an opening 22 therein extending into the front side 16 and outwardly of the back side 18. The opening 22 has a rectangular shape. The opening 22 may have a height between 26 inches and 30 inches and a width between 14 inches and 18 inches. This size generally relates to the size of a strike zone in baseball to help indicate a person's throwing accuracy. The support 12 further includes a rear wall 24 that is hingedly coupled to the front wall 14 along an upper edge 26 of the front wall 14 and an upper edge 28 of the rear wall 16. The rear wall 16 has a first side 30 and a second side 32. The rear wall 30 may have an aperture 34 extending through the first 30 and second 32 sides.

A ball catch 36 is mounted to the back side 18 and covers the opening 22. The ball catch 36 is formed of a loose material configured to catch and retain a ball thrown through the opening 22. The ball catch 36 may be comprised of a loose netting material that hangs downwardly and rearwardly of the front wall 14.

A panel 38 is provided which is comprised of a resilient stretchable material. The panel 38 is attached to the rear wall 24 and coves the aperture 34. The panel 38 may be secured to the rear wall 24 with a series of bands 40. The panel 38 is stretched taut over the aperture 34 and is configured to bounce a ball away from the rear wall 24 when the ball strikes the panel 38. The panel 38 allows a person to throw a ball at the assembly 10 so that the ball bounces back to the person throwing the ball.

Figure 6:
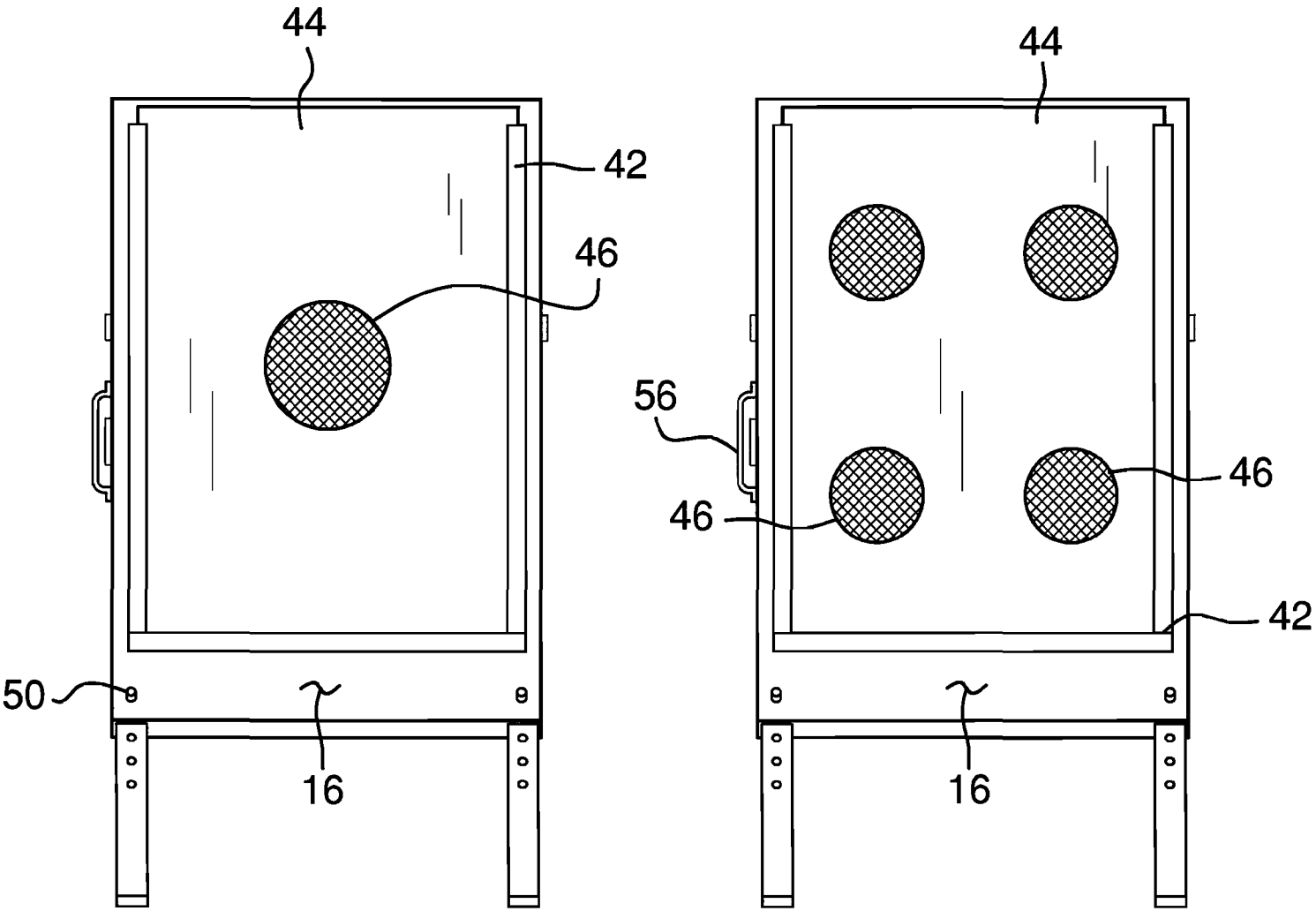
FIG. 6 is a front view of an embodiment of the disclosure.

A guide 42 may be attached to the front side 16 of the front wall 14. A target 44 is removably mounted in the guide. The target 44 partially covers the opening 22. As can be seen in FIG. 6, different targets may be provided, each with varying sized holes 46 therein to provide targets for a person to aim for. Aside from baseballs and Wiffle balls, the targets 44 may be used for golfing, footballs, hockey pucks and the like. The ball catch 36 may include a flap 60 which is selectively positioned in an open or closed position. The flap 60 may simply comprise a portion of the ball catch 36 cut away which can be closed with conventional fasteners 62 such as hook and loop fasteners, snaps or the like. By opening the flap 60, a user can access objects thrown through the target 44 without having to remove the target to access the ball catch 36.

Figure 3:
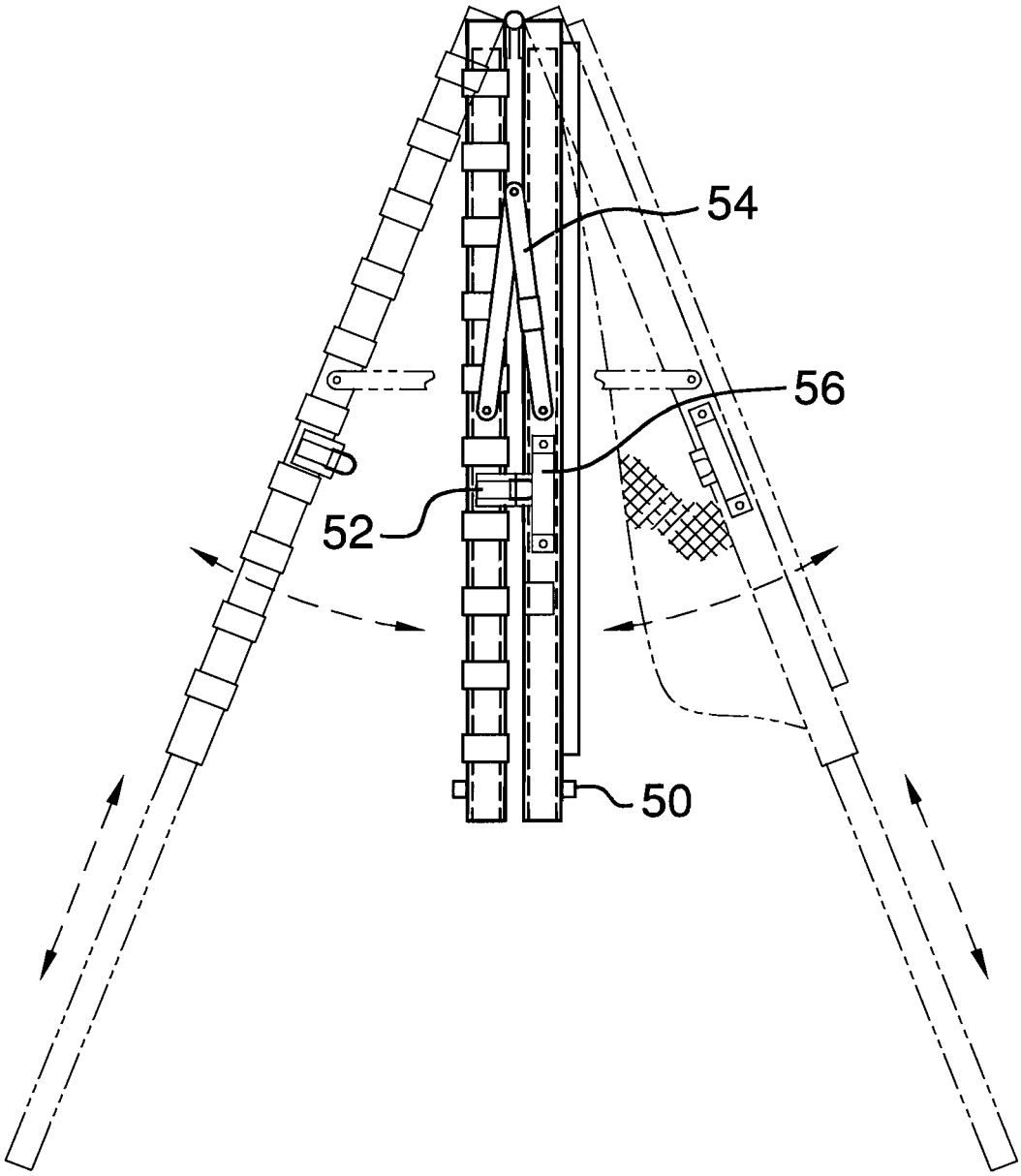
FIG. 3 is a side view of an embodiment of the disclosure.
Figure 4:
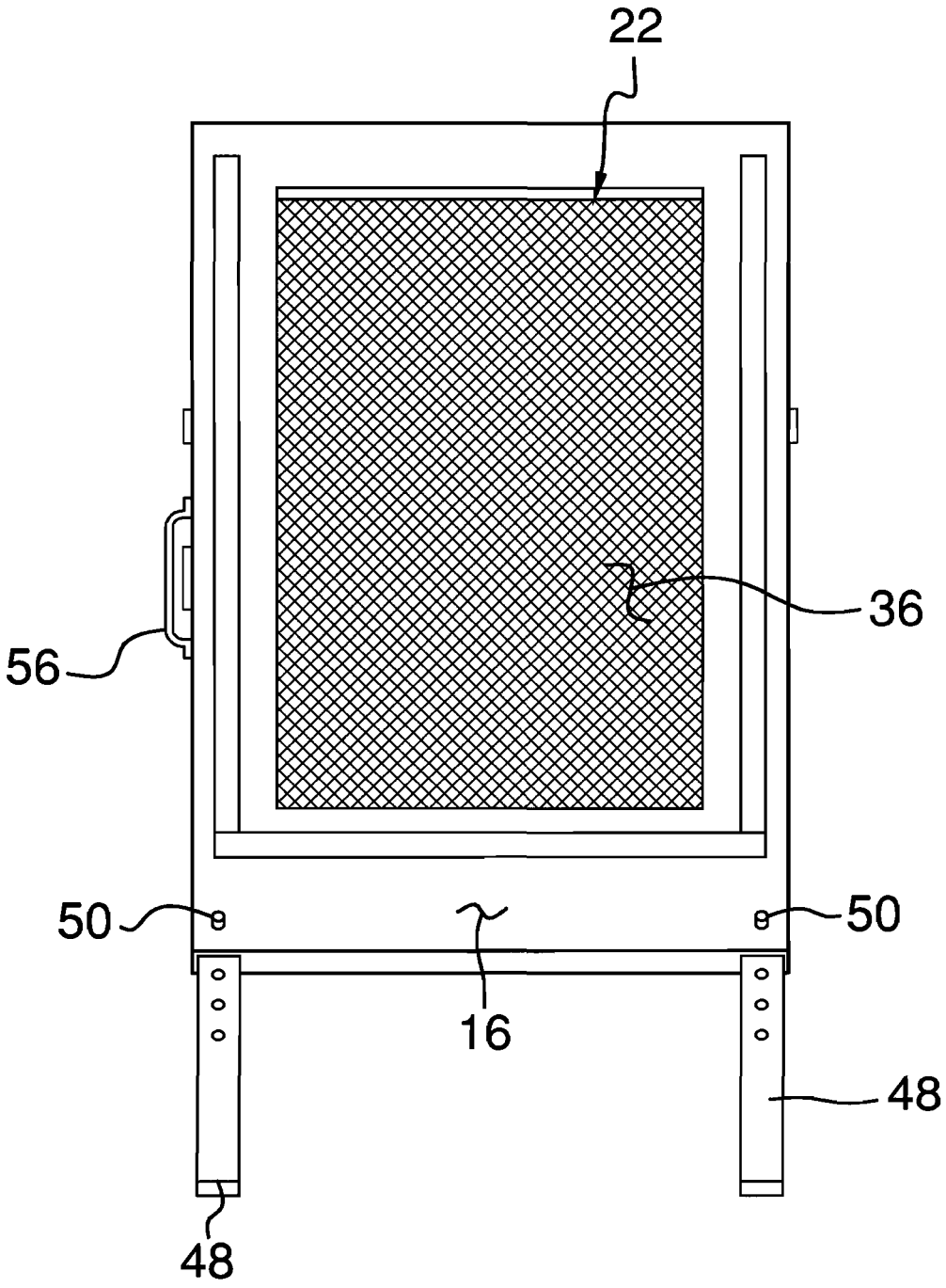
FIG. 4 is a front view of an embodiment of the disclosure.
Figure 5:
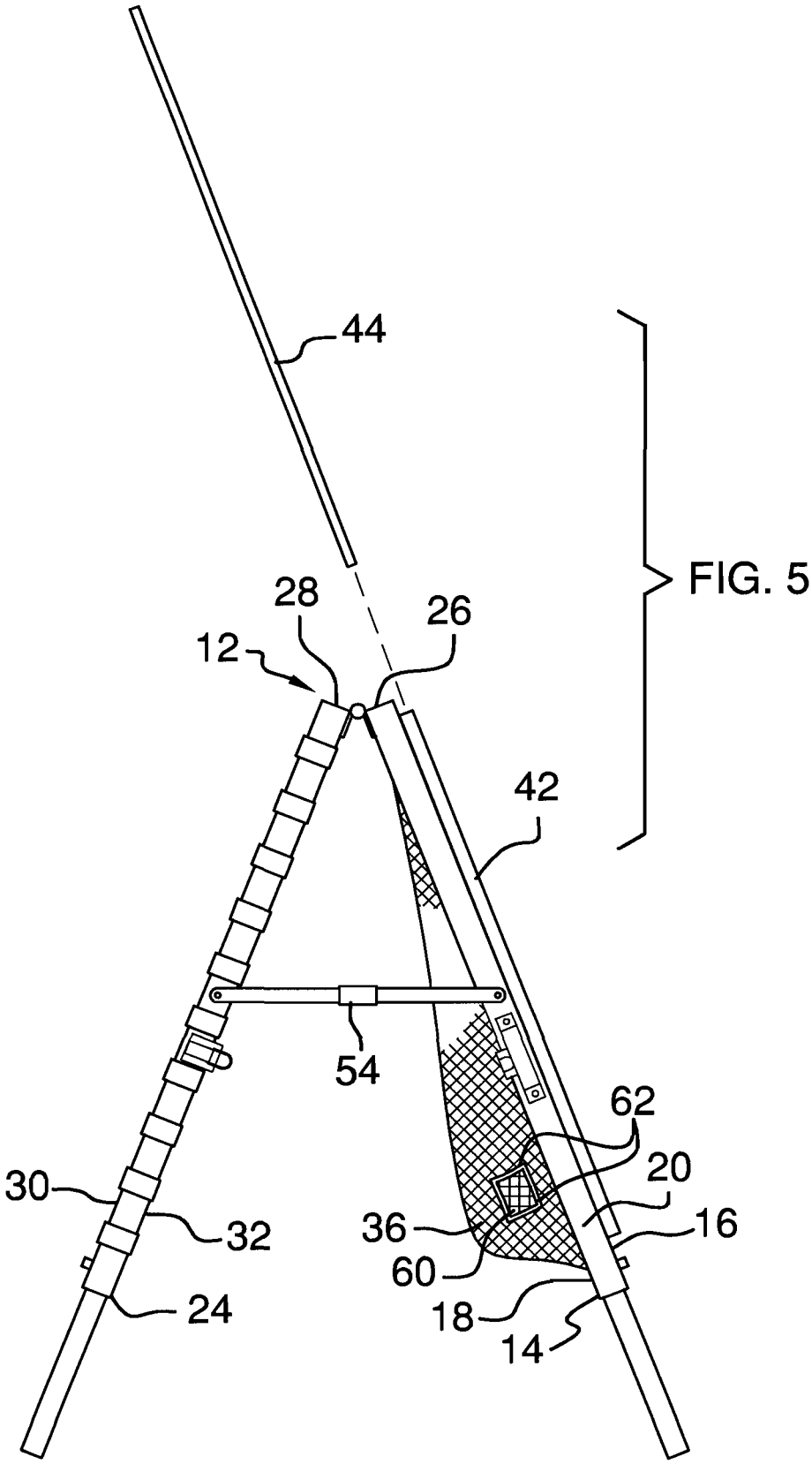
FIG. 5 is a side view of an embodiment of the disclosure.

A plurality legs 48 is attached to the support 12 and extends downwardly therefrom. The legs 48 may be slidably coupled to the support 12 to allow a height of the legs 48 to be adjusted. Locking members 50 lock the legs 48 at a desired height. A latch 52 is attached to the support 12 and releasably secures front 14 and rear 24 walls in a folded position defined by the front 14 and rear 24 walls is orientated parallel to each other as shown in FIG. 3. A brace 54 may be attached to and extended between the front 14 and rear 24 walls. The brace 54 retains the front 14 and rear 24 walls in a deployed position wherein the front 14 and rear 24 walls form an angle between 15° and 50°. A handle 56 is attached to the support 12, and may be mounted on the perimeter edge 20 of the front wall 14, to allow for easy transportation of the assembly 10.

In use, the assembly 10 is set up so that a person can thrown a ball at either the front wall 14 or the rear wall 24. If the person wishes to simply throw the ball at a target 44, they may throw the ball into the catch 36. Alternatively, person may throw a ball at the rear wall 24 so that the panel 36 bounces the ball back to the person. To increase the difficulty of throwing a ball into the catch 36, the target 44 may be positioned over the opening 22.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A ball catch apparatus comprising:

a support including;

a front wall having a front side, a back side and a perimeter edge extending between said front and back sides, said front wall having an opening therein extending into said front side and outwardly of said back side;

a rear wall being hingedly coupled to said front wall along an upper edge of said front wall and an upper edge of said rear wall;

a ball catch being mounted to said back side and covering said opening, said ball catch being formed of a loose material configured to catch and retain a ball thrown through said opening; and a flap in said ball catch wherein said flap comprises a portion of said ball catch being cut away, said flap being selectively positioned in an opened position to retrieve the ball thrown into said ball catch and in a closed position to retain the ball within said ball catch.

2. The apparatus according to claim 1, wherein said opening has a rectangular shape, said opening having a height between 26 inches and 30 inches and a width between 14 inches and 18 inches.

3. The apparatus according to claim 1, further including:

said rear wall having a first side and a second side, said rear wall having an aperture extending therethrough;

a panel comprised of a resilient stretchable material being attached to said rear wall and covering said aperture, said panel being stretched taut over said aperture and being configured to bounce a ball away from said rear wall when the ball strikes said panel.

4. The apparatus according to claim 1, further including:

a guide being attached to said front side of said front wall; and a target being removably mounted in said guide, said target partially covering said opening.

5. The apparatus according to claim 1, further including a plurality legs being attached to said support and extending downwardly therefrom.

6. The apparatus according to claim 1, further including a latch being attached to said support and releasably securing front and rear walls in a folded position defined by said front and rear walls being orientated parallel to each other.

7. The apparatus according to claim 1, further including a brace being attached to and extending between said front and rear walls, said brace retaining said front and rear walls in a deployed position wherein said front and rear walls form an angle between 15° and 50°.

8. The apparatus according to claim 1, further including a handle being attached to said perimeter edge of said front wall.

9. The apparatus according to claim 6, further including a handle being attached to said perimeter edge of said front wall.

10. A ball catch apparatus comprising:

a support including;

a front wall having a front side, a back side and a perimeter edge extending between said front and back sides, said front wall having an opening therein extending into said front side and outwardly of said back side, said opening having a rectangular shape, said opening having a height between 26 inches and 30 inches and a width between 14 inches and 18 inches;

a rear wall being hingedly coupled to said front wall along an upper edge of said front wall and an upper edge of said rear wall, said rear wall having a first side and a second side, said rear wall having an aperture extending therethrough;

a ball catch being mounted to said back side and covering said opening, said ball catch being formed of a loose material configured to catch and retain a ball thrown through said opening;

a flap in said ball catch wherein said flap comprises a portion of said ball catch being cut away, said flap being selectively positioned in an opened position to retrieve the ball thrown into said ball catch and in a closed position to retain the ball within said ball catch;

at least one fastener coupling said flap to said ball catch to retain said flap in the closed position;

a panel comprised of a resilient stretchable material being attached to said rear wall and covering said aperture, said panel being stretched taut over said aperture and being configured to bounce a ball away from said rear wall when the ball strikes said panel;

a guide being attached to said front side of said front wall;

a target being removably mounted in said guide, said target partially covering said opening;

a plurality legs being attached to said support and extending downwardly therefrom;

a latch being attached to said support and releasably securing front and rear walls in a folded position defined by said front and rear walls being orientated parallel to each other;

a brace being attached to and extending between said front and rear walls, said brace retaining said front and rear walls in a deployed position wherein said front and rear walls form an angle between 15° and 50°; and a handle being attached to said perimeter edge of said front wall.

* * * * *